US010686245B2

(12) United States Patent
Hayashi et al.

(10) Patent No.: US 10,686,245 B2
(45) Date of Patent: Jun. 16, 2020

(54) BACK DOOR, AND GLASS ANTENNA

(71) Applicant: AGC INC., Tokyo (JP)

(72) Inventors: Takuji Hayashi, Tokyo (JP); Satoshi Tokunaga, Tokyo (JP)

(73) Assignee: AGC INC., Tokyo (JP)

( * ) Notice: Subject to any disclaimer, the term of this patent is extended or adjusted under 35 U.S.C. 154(b) by 77 days.

(21) Appl. No.: 15/465,130

(22) Filed: Mar. 21, 2017

(65) Prior Publication Data

US 2017/0279182 A1 Sep. 28, 2017

(30) Foreign Application Priority Data

Mar. 22, 2016 (JP) ..... 2016-057453

(51) Int. Cl.

| | |
|---|---|
| ***H01Q 1/52*** | (2006.01) |
| ***H01Q 1/12*** | (2006.01) |
| ***H01Q 9/42*** | (2006.01) |
| ***H01Q 7/00*** | (2006.01) |

(52) U.S. Cl.

CPC ..... *H01Q 1/1278* (2013.01); *H01Q 1/52* (2013.01); *H01Q 7/00* (2013.01); *H01Q 9/42* (2013.01)

(58) Field of Classification Search

CPC .. H01Q 1/1271; H01Q 1/3275; H01Q 1/1278; H01Q 1/3283; H01Q 1/02

USPC ..... 343/713, 712, 704

See application file for complete search history.

(56) References Cited

U.S. PATENT DOCUMENTS

| | | | | |
|---|---|---|---|---|
| 5,049,892 | A * | 9/1991 | Lindenmeier | H01Q 1/1271 343/701 |
| 5,557,289 | A | 9/1996 | Ohara | |
| 2004/0056810 | A1 | 3/2004 | Oka | |
| 2005/0035913 | A1* | 2/2005 | Baranski | H01Q 1/1278 343/713 |
| 2006/0152421 | A1 | 7/2006 | Baranski | |
| 2011/0043419 | A1* | 2/2011 | Noguchi | H01Q 1/1278 343/712 |
| 2016/0269059 | A1 | 9/2016 | Funatsu et al. | |

FOREIGN PATENT DOCUMENTS

| | | | |
|---|---|---|---|
| EP | 1177596 | A1 | 2/2002 |
| EP | 2 109 181 | A1 | 10/2009 |
| EP | 2 299 538 | A1 | 3/2011 |
| JP | H09-008527 | A | 1/1997 |
| JP | 09-181513 | A | 7/1997 |
| JP | 2010-011005 | A | 1/2010 |
| JP | 2015-056716 | A | 3/2015 |
| JP | 2016-025604 | A | 2/2016 |
| WO | WO-2008/096751 | A1 | 8/2008 |
| WO | WO-2015/093490 | A1 | 6/2015 |

OTHER PUBLICATIONS

Extended European Search Report for European Patent Application No. 17000462.6 dated Aug. 23, 2017.

* cited by examiner

*Primary Examiner* — Graham P Smith
(74) *Attorney, Agent, or Firm* — Foley & Lardner LLP

(57) ABSTRACT

The present invention provides a back door and a glass antenna capable of achieving an inexpensive antenna in which external components can be reduced. The present invention relates to a back door and a glass antenna, in which no choke coil which blocks a signal of a first frequency band between a body of a vehicle and a defogger is provided.

14 Claims, 6 Drawing Sheets

BACK DOOR, AND GLASS ANTENNA

FIELD OF THE INVENTION

The present invention relates to a back door, and a glass antenna.

BACKGROUND OF THE INVENTION

In the background art, in a hatchback vehicle having a back door in a rear portion of the vehicle, a rear glass of the back door generally has a small area in comparison with those in other vehicle models. In addition, almost all the region of the rear glass is occupied by a defogger. In the hatchback vehicle, it is therefore difficult to secure a region in which an antenna for AM (Amplitude Modulation) radio is disposed in the rear glass. Thus, a technique using the defogger as an antenna for AM radio has been known.

For example, when the defogger is used as an antenna for AM radio, a reception signal may leak from the defogger to a body of the vehicle, or noise from the body of the vehicle may be mixed into the reception signal. Therefore, when the defogger is used as an antenna for AM radio, a choke coil is used for blocking a signal in a frequency band of AM radio between the body of the vehicle and the defogger (for example, see Patent Document 1).

Patent Document 1: JP-A-2015-56716

SUMMARY OF THE INVENTION

However, when a choke coil is used, the weight and the cost of the vehicle increase due to the choke coil. There is a problem that the choke coil is hardly used in a low-priced popular vehicle. Therefore, an inexpensive antenna in which external components such as a choke coil can be reduced is demanded in a hatchback vehicle.

The present invention has been developed to solve the foregoing problem. An object of the present invention is to provide a back door and a glass antenna capable of achieving an inexpensive antenna in which external components can be reduced.

The present invention has the following configurations.

[1] A back door made from resin to be openably and closably attached to a rear portion of a vehicle, the back door including a glass antenna, in which the glass antenna includes:

a defogger including a plurality of heating wires and at least two bus bars which connect end portions of the heating wires so as to supply electric power to the heating wires;

a first antenna wire which is disposed in regions of at least three sides in a peripheral region of the defogger, so as to receive radio waves in a first frequency band;

a second antenna wire which is disposed in the peripheral region of the defogger, so as to receive radio waves in a second frequency band which is higher in frequency than the first frequency band; and an amplification portion which synthesizes and amplifies a first reception signal received by the first antenna wire and a second reception signal received by the second antenna wire, and in which the glass antenna has no choke coil which blocks a signal of the first frequency band between a body of the vehicle and the defogger.

[2] The back door according to [1], in which:

the amplification portion is connected to the first antenna wire through a first feeding point and connected to the second antenna wire through a second feeding point; and the first feeding point and the second feeding point are disposed in the peripheral region and outside a line along each of the at least two bus bars and an extension line of the line.

[3] The back door according to [2], in which:

the second feeding point is disposed in a position closer to the defogger than the first feeding point.

[4] The back door according to any one of [1] to [3], in which:

the first antenna wire is disposed at a first distance or longer from the defogger; and the second antenna wire is disposed at a second distance from the defogger, the second distance being shorter than the first distance.

[5] The back door according to any one of [1] to [4], in which:

the first antenna wire includes a meander-like conducting wire part; and an interval between conducting wires in the meander-like conducting wire part is shorter than an interval between the defogger and the first antenna wire.

[6] The back door according to [5], in which:

the interval between the conducting wires in the meander-like conducting wire part is determined so that the conducting wires are capacitively coupled with each other in the first frequency band.

[7] A glass antenna for use in a back door made from resin to be openably and closably attached to a rear portion of a vehicle, the glass antenna including:

a defogger including a plurality of heating wires and at least two bus bars which connect end portions of the heating wires so as to supply electric power to the heating wires;

a first antenna wire which is disposed in regions of at least three sides in a peripheral region of the defogger, so as to receive radio waves in a first frequency band;

a second antenna wire which is disposed in the peripheral region of the defogger, so as to receive radio waves in a second frequency band which is higher in frequency than the first frequency band; and an amplification portion which synthesizes and amplifies a first reception signal received by the first antenna wire and a second reception signal received by the second antenna wire, in which the glass antenna has no choke coil which blocks a signal of the first frequency band between a body of the vehicle and the defogger.

According to a back door of the present invention, it is possible to achieve an inexpensive antenna in which external components can be reduced.

According to a glass antenna of the present invention, it is possible to achieve an inexpensive antenna in which external components can be reduced.

DETAILED DESCRIPTION OF THE INVENTION

A back door and a glass antenna according to each embodiment of the present invention will be described below with reference to the drawings.

First Embodiment

Figure 1:
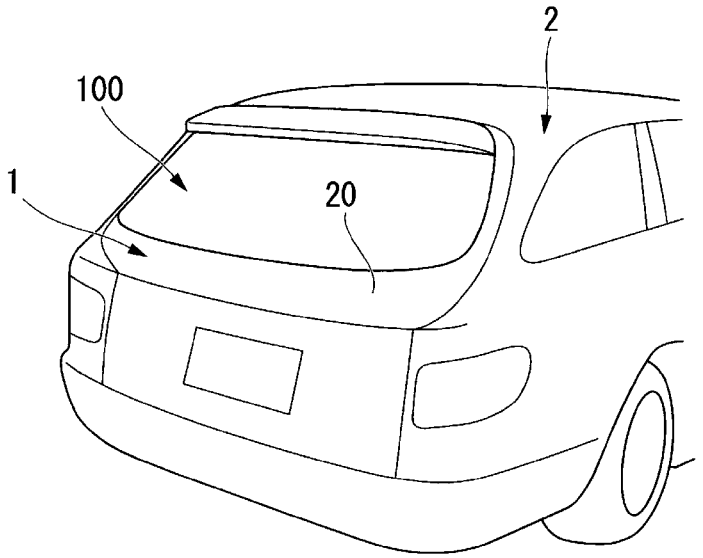
FIG. 1 is an outline view showing an example in which a back door and a glass antenna according to a first embodiment have been mounted on a vehicle.
Figure 2:
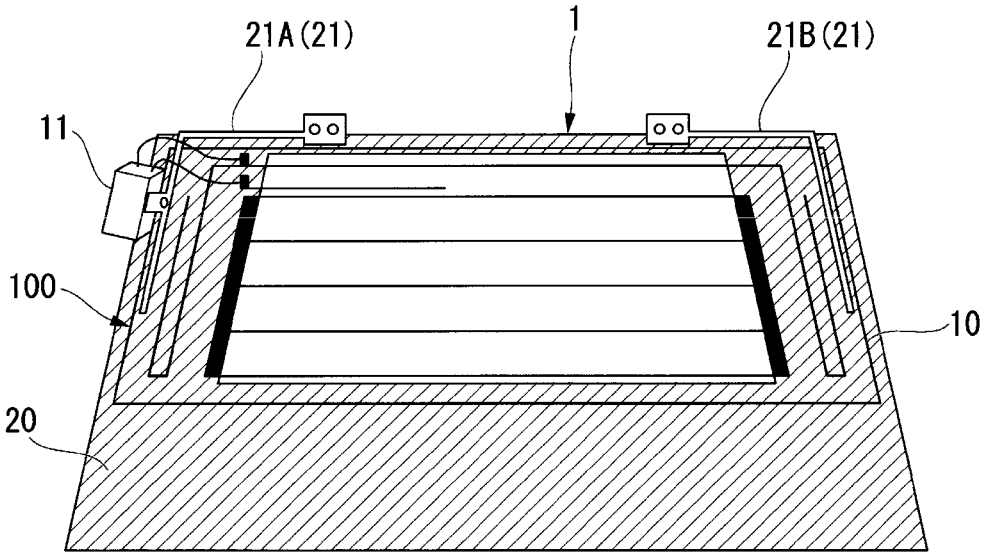
FIG. 2 is a view showing an internal configuration example of the back door according to the first embodiment.

FIG. 1 is an outline view showing an example in which a back door 1 and a glass antenna 100 according to a first embodiment have been mounted on a vehicle. In addition, FIG. 2 is a view showing an internal configuration view of the back door 1 according to the present embodiment.

The back door 1 shown in FIG. 1 is openably and closably attached to a rear portion of a vehicle body 2 of a hatchback vehicle. The back door 1 is a door made from resin, including a resin panel 20, metal frames (21A and 21B), and a glass antenna 100.

In the back door 1, the metal frames (21A and 21B) and the glass antenna 100 are mounted between a resin outer panel (not shown) and a resin inner panel (not shown) of the resin panel 20. The back door 1 is openably and closably attached to the vehicle body 2 through the metal frames (21A and 21B).

The resin panel 20 (the resin outer panel and the resin inner panel) is formed of synthetic resin (such as polypropylene). For example, the resin panel 20 can transmit radio waves in a frequency band of AM radio (an example of a first frequency band, ranging from 525 kHz (kilohertz) to 1,710 kHz) and a frequency band of FM (Frequency Modulation) radio (an example of a second frequency band, ranging from 76 MHz (megahertz) to 108 MHz). In addition, the resin panel 20 has an opening portion for visually recognizing a rear side of the vehicle.

The metal frames (21A and 21B) are disposed between the resin outer panel and the resin inner panel, and provided for enhancing rigidity of the back door 1.

FIG. 2 shows an internal configuration example of the back door 1 in which the resin inner panel has been removed. As shown in FIG. 2, the metal frame 21A is attached to a left side portion of the back door 1, and the metal frame 21B is attached to a right side portion of the back door 1.

In the present embodiment, the metal frame 21A and the metal frame 21B will be described as metal frames 21 when any one of the metal frames provided in the back door 1 is designated or when the metal frames provided in the back door 1 are not distinguished especially.

The glass antenna 100 is disposed between the resin outer panel and the resin inner panel so that the rear side of the vehicle can be visually recognized. The glass antenna 100 has a rear glass 10 and a two-input amplifier 11 as shown in FIG. 2.

The rear glass 10 is, for example, formed of glass. The rear glass 10 is disposed in the opening portion of the resin panel 20 (the resin outer panel and the resin inner panel) so that the rear side of the vehicle can be visually recognized.

The two-input amplifier 11 (an example of an amplification portion) is fixed to the metal frame 21A, and electrically connected to the vehicle body 2 through the metal frame 21A. The two-input amplifier 11 uses potential of the vehicle body 2 as reference potential (for example, ground).

Figure 3:
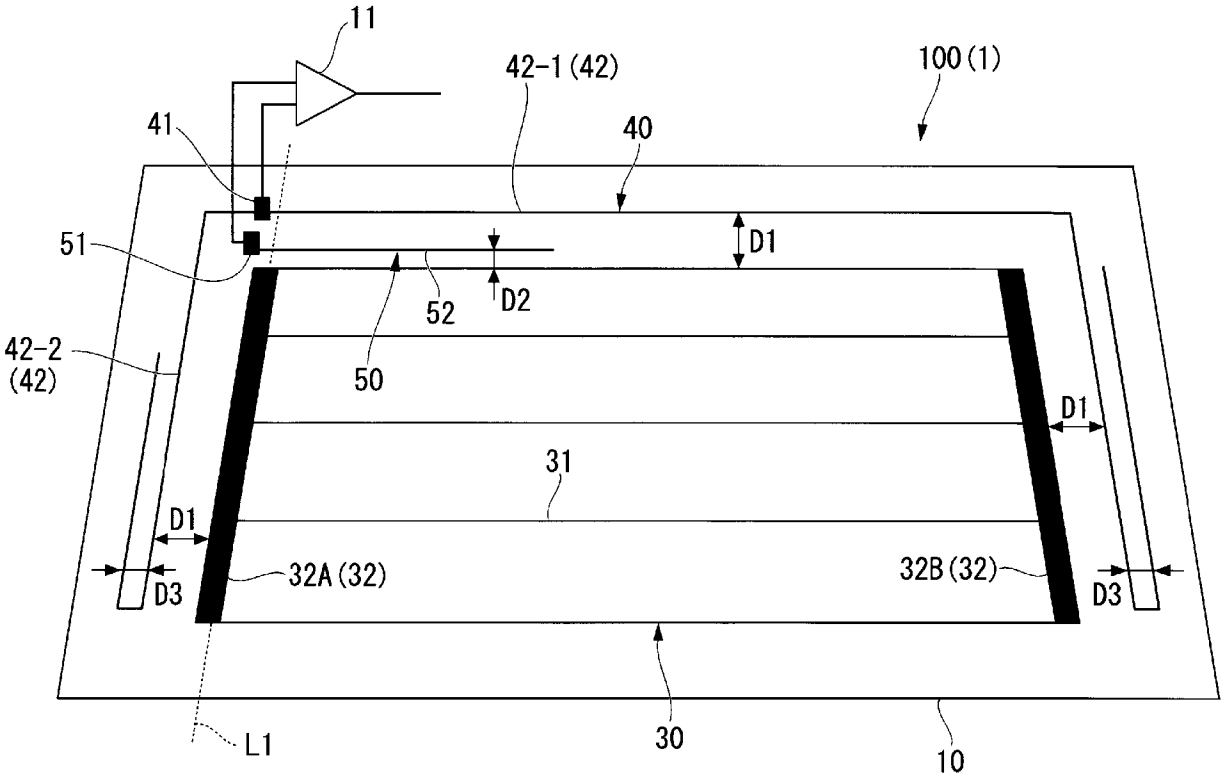
FIG. 3 is a view showing a configuration example of the glass antenna according to the first embodiment.

FIG. 3 is a view showing a configuration example of the glass antenna 100 according to the present embodiment.

The glass antenna 100 shown in FIG. 3 has the rear glass 10 and the two-input amplifier 11. A defogger 30, an AM antenna 40 and an FM antenna 50 are disposed in the rear glass 10.

The defogger 30 is disposed at the center of the rear glass 10. The defogger 30 has a plurality of heating wires 31 and at least two bus bars (32A and 32B). The defogger 30 heats the heating wires 31 by electric power supplied between the bus bar 32A and the bus bar 32B, so as to eliminate bedewing on the rear glass 10.

The two bus bars (32A and 32B) connect end portions of the heating wires 31 and supply electric power to the heating wires 31. For example, the bus bar 32A is disposed on the left side of the defogger 30 when observed from the resin inner panel side, and the bus bar 32B is disposed on the right side of the defogger 30 when observed from the resin inner panel side. The bus bar 32A and the bus bar 32B will be described as bus bars 32 when any one of the bus bars provided in the glass antenna 100 is designated or when the bus bars are not distinguished especially.

The AM antenna 40 is an antenna for AM radio, which receives radio waves in a frequency band of AM radio. The AM antenna 40 has an AM feeding point 41 and an AM antenna wire 42.

The AM feeding point 41 (an example of a first feeding point) is a terminal, which is constituted by a conductor such as metal so as to feed power to the AM antenna wire 42. The AM feeding point 41 is disposed in the peripheral region of the defogger 30 within the rear glass 10 and outside a line along each of the at least two bus bars 32 and an extension line of the line (for example, an imaginary line L1). That is, the AM feeding point 41 is disposed outside the imaginary line L1 including a line along the bus bar 32A and an extension line of the line.

The AM antenna wire 42 (an example of a first antenna wire) is a conducting wire such as metal, which is disposed in regions of at least three sides in the peripheral region of the defogger 30 within the rear glass 10. For example, the AM antenna wire 42 is disposed over, in the peripheral region of the defogger 30, an upper region on the upper side of the heating wires 31, a left region on the left side of the bus bar 32A, and a right region on the right side of the bus bar 32B. In addition, the AM antenna wire 42 is disposed at a distance D1 (an example of a first distance) or longer from the defogger 30. The distance D1 is a predetermined distance long enough to prevent leakage (attenuation) of a reception signal of the AM antenna wire 42 to the vehicle body 2 through the defogger 30 or to prevent noise from being mixed from the vehicle body 2 into the reception signal of the AM antenna wire 42. For example, the distance D1 is 40 mm (millimeters).

In addition, the AM antenna wire 42 includes an AM antenna wire 42-1 (AM element) extending to the right from the AM feeding point 41, and an AM antenna wire 42-2 (AM element) extending to the left from the AM feeding point 41.

The AM antenna wire 42-1 is a conducting wire disposed in the aforementioned upper region and the aforementioned right region and having a pattern folded back to the outside in the right region. An interval between conducting wires of the AM antenna wire 42-1 in the folded-back section is a distance D3 which is shorter than the distance D1. The distance D3 is determined so that the conducting wires can be capacitively coupled with each other in the frequency band of AM radio. For example, the distance D3 is 10 mm.

The AM antenna wire 42-2 is a conducting wire disposed in the aforementioned left region and having a pattern folded back to the outside in the left region. An interval between conducting wires of the AM antenna wire 42-2 in the folded-back section is a distance D3 which is shorter than the distance D1 in the same manner as in the AM antenna wire 42-1.

The FM antenna 50 is an antenna for FM radio, which receives radio waves in a frequency band of FM radio. The FM antenna 50 has an FM feeding point 51 and an FM antenna wire 52.

The FM feeding point 51 (an example of a second feeding point) is a terminal, which is constituted by a conductor such as metal so as to feed power to the FM antenna wire 52. The FM feeding point 51 is disposed in the peripheral region of the defogger 30 within the rear glass 10 and outside a line along each of the at least two bus bars 32 and an extension line of the line (for example, the imaginary line L1). That is, the FM feeding point 51 is disposed outside the imaginary line L1 including a line along the bus bar 32 and an extension line of the line. In addition, the FM feeding point 51 is disposed in a position closer to the defogger 30 than the AM feeding point 41.

In addition, the FM antenna wire 52 (an example of a second antenna wire) is a conducting wire extending to the right from the FM feeding point 51. The FM antenna wire 52 is disposed in the peripheral region of the defogger 30 (for example, the aforementioned upper region) so as to receive radio waves in the frequency band of FM radio which is higher than in frequency the frequency band of AM radio. In addition, the FM antenna wire 52 is disposed at a distance D2 (an example of a second distance) from the defogger 30. The distance D2 is shorter than the distance D1. That is, the FM antenna wire 52 is disposed between the AM antenna wire 42 and the defogger 30. The distance D2 is determined so that the FM antenna wire 52 is capacitively coupled with the defogger 30 in the frequency band of FM radio. For example, the distance D2 is 5 mm.

The two-input amplifier 11 is connected to the AM antenna wire 42 through the AM feeding point 41 and connected to the FM antenna wire 52 through the FM feeding point 51. The two-input amplifier 11 synthesizes and amplifies an AM reception signal (an example of a first reception signal) received by the AM antenna wire 42 and an FM reception signal (an example of a second reception signal) received by the FM antenna wire 52. Although the two-input amplifier 11 shown in FIG. 3 is disposed above the rear glass 10 for convenience of explanation, the two-input amplifier 11 is fixed to the metal frame 21A as shown in FIG. 2. For example, the two-input amplifier 11 outputs an output signal, in which the AM reception signal and the FM reception signal have been mixed, to devices such as a car radio system and a car audio system mounted on a car, through a coaxial feeder wire or the like.

In the present embodiment, as shown in FIG. 2, the AM antenna 40, the FM antenna 50, and the two-input amplifier 11 are covered with the resin panel 20 (the resin outer panel and the resin inner panel) so that they cannot be visually recognized from the outside.

In addition, the glass antenna 100 according to the present embodiment requires no choke coil which blocks a signal in the frequency band of AM radio between the vehicle body 2 (a body of a vehicle) and the defogger 30. The choke coil, which is a coil for adjusting impedance to high impedance in the frequency band of AM radio, is dispensable because the AM antenna wire 42 is disposed at the distance D1 or longer (at the first distance or longer) from the defogger 30.

As described above, the back door 1 according to the present embodiment is a back door 1 which is made from resin, provided with a glass antenna 100 and openably and closably attached to a rear portion of a vehicle. The glass antenna 100 includes a defogger 30, an AM antenna wire 42, an FM antenna wire 52, and a two-input amplifier 11. The defogger 30 includes a plurality of heating wires 31 and at least two bus bars 32 which connect end portions of the heating wires 31 so as to supply electric power to the heating wires 31. The AM antenna wire 42 is disposed in regions of at least three sides in a peripheral region of the defogger 30, so as to receive radio waves in a frequency band of AM radio. The FM antenna wire 52 is disposed in the peripheral region of the defogger 30 so as to receive radio waves in a frequency band of FM radio which is higher in frequency than the frequency band of AM radio. The two-input amplifier 11 synthesizes and amplifies an AM reception signal received by the AM antenna wire 42 and an FM reception signal received by the FM antenna wire 52. The glass antenna 100 has no choke coil which blocks a signal in the frequency band of AM radio between a vehicle body 2 (a body of the vehicle) and the defogger 30.

Since the back door 1 according to the present embodiment is thus made from resin, radio waves in the frequency band of AM radio can be received by the AM antenna wire 42 disposed in regions of at least three sides in the peripheral region of the defogger 30, while radio waves in the frequency band of FM radio can be received by the FM antenna wire 52 disposed in the peripheral region. Further, in the back door 1 according to the present embodiment, since the AM antenna 42 is disposed in the regions of at least three sides, a sufficient antenna area can be secured for the AM antenna 40, so that receiving sensitivity can be improved. Thus, in the back door 1 according to the present embodiment, it is not necessary to provide a choke coil which blocks a signal in the frequency band of AM radio between the vehicle body 2 (the body of the vehicle) and the defogger 30. In the back door 1 according to the present embodiment, it is therefore possible to achieve an inexpensive antenna in which external components can be reduced. In addition, since the back door 1 according to the present embodiment requires no choke coil, weight can be reduced. The back door 1 according to the present embodiment can be, for example, used in a low-priced popular vehicle.

In addition, in the back door 1 according to the present embodiment, due to the two-input amplifier 11 provided for synthesizing and amplifying an AM reception signal and an FM reception signal, the reception signals can be transmitted to devices such as a car radio system and a car audio system through a single signal line. Accordingly, in the back door 1 according to the present embodiment, weight and cost can be reduced in comparison with a case in which the AM reception signal and the FM reception signal are transmitted through respective signal lines.

In addition, according to the present embodiment, the two-input amplifier 11 is connected to the AM antenna wire 42 through an AM feeding point 41 (a first feeding point), and connected to the FM antenna wire 52 through an FM feeding point 51 (a second feeding point). The AM feeding point 41 and the FM feeding point 51 are disposed in the aforementioned peripheral region and outside a line along each of the at least two bus bars 32 and an extension line of the line (for example, an imaginary line L1).

Thus, in the back door 1 according to the present embodiment, when the two-input amplifier 11 is, for example, disposed near the AM feeding point 41 and the FM feeding point 51, the wiring length for connection to the two-input amplifier 11 from the AM feeding point 41 and the FM feeding point 51 can be made shorter. Accordingly, in the back door 1 according to the present embodiment, the possibility that noise may be mixed into a reception signal from the wiring can be reduced. Thus, it is possible to further improve the receiving sensitivity of the antenna. Since the wiring length can be shortened in the back door 1 according to the present embodiment, a variation in performance among products can be reduced. In addition, since the AM feeding point 41 and the FM feeding point 51 are disposed in positions where they can be covered with the resin panel 20, the design quality of the rear glass 10 can be improved in the back door 1 according to the present embodiment.

In addition, according to the present embodiment, the FM feeding point 51 is disposed in a position closer to the defogger 30 than the AM feeding point 41. In addition, the FM antenna wire 52 is disposed between the defogger 30 and the AM antenna wire 42.

As a result, in the back door 1 according to the present embodiment, the AM feeding point 41 and the AM antenna wire 42 (the AM antenna 40) can be put at a longer distance from the defogger 30. It is therefore possible to reduce leakage (attenuation) of a reception signal of the AM antenna wire 42 to the vehicle body 2 through the defogger 30, and noise mixed from the vehicle body 2 into the reception signal of the AM antenna wire 42.

In addition, according to the present embodiment, the AM antenna wire 42 is disposed at a distance D1 (a first distance) or longer from the defogger 30, and the FM antenna wire 52 is disposed at a distance D2 (a second distance) from the defogger 30. The distance D2 is shorter than the distance D1.

As a result, in the back door 1 according to the present embodiment, it is possible to reduce leakage (attenuation) of a reception signal of the AM antenna wire 42 through the defogger 30, and noise mixed into the reception signal of the AM antenna wire 42. In addition, in the back door 1 according to the present embodiment, the FM antenna wire 52 and the defogger 30 are capacitively coupled with each other so that receiving sensitivity of the FM antenna wire 52 can be improved. Thus, in the back door 1 according to the present embodiment, it is possible to further improve receiving sensitivity in the frequency band of AM radio and the frequency band of FM radio.

In addition, the glass antenna 100 according to the present embodiment is used in the back door 1 which is made from resin and is to be openably and closably attached to the rear portion of the vehicle. The glass antenna 100 includes the defogger 30, the AM antenna wire 42, the FM antenna wire 52, and the two-input amplifier 11. The glass antenna 100 has no choke coil which blocks a signal in the frequency band of AM radio between the vehicle body 2 (the body of the vehicle) and the defogger 30.

Thus, in the glass antenna 100 according to the present embodiment, in the same manner as in the back door 1, it is possible to achieve a low-priced antenna in which external components can be reduced, and it is possible to reduce the weight of the antenna.

Second Embodiment

Next, a glass antenna 100*a* according to a second embodiment will be described with reference to FIG. 4.

Figure 4:
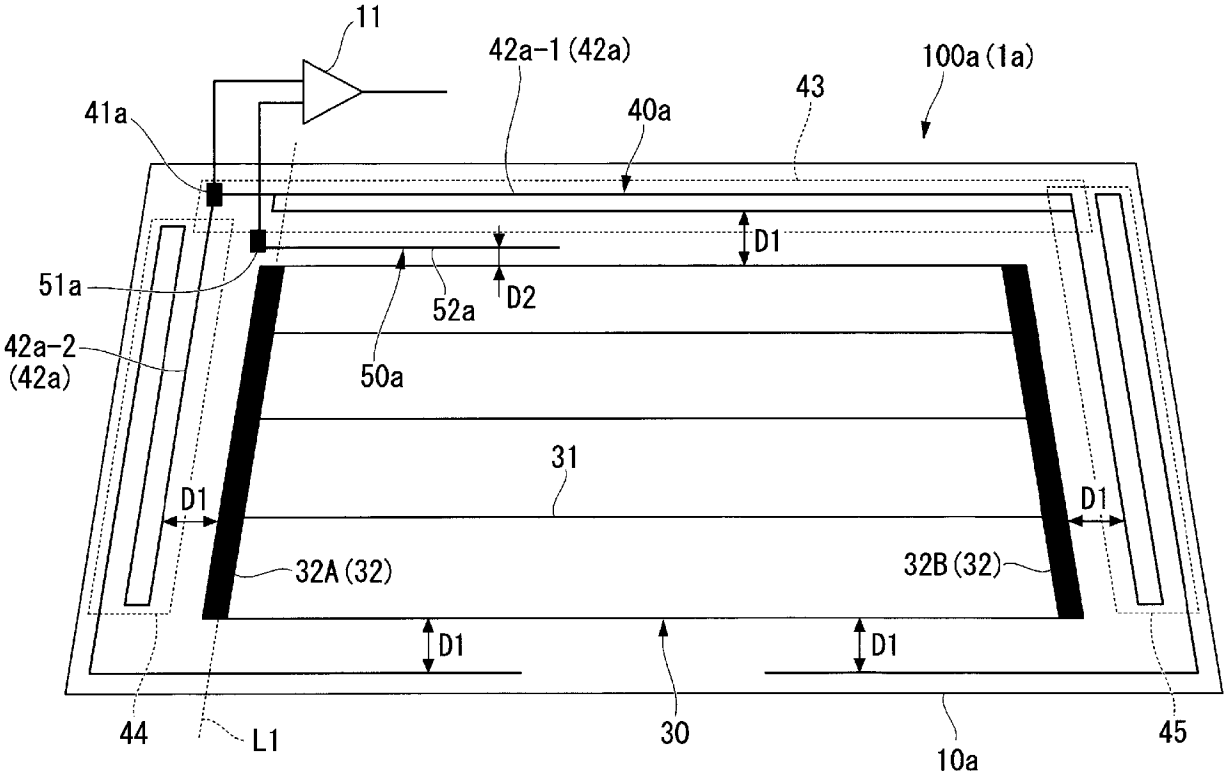
FIG. 4 is a view showing a configuration example of a glass antenna according to a second embodiment.

FIG. 4 is a view showing a configuration example of the glass antenna 100*a* according to the second embodiment.

Incidentally, a back door 1*a* according to the second embodiment is the same as the back door 1 according to the first embodiment, except that the glass antenna 100*a* is provided in place of the glass antenna 100. Therefore, description of the back door 1*a* will be omitted.

The glass antenna 100*a* shown in FIG. 4 has a rear glass 10*a* and a two-input amplifier 11. A defogger 30, an AM antenna 40*a* and an FM antenna 50*a* are disposed in the rear glass 10*a*. In FIG. 4, constituent members which are the same as those in FIG. 3 are referenced correspondingly, and description thereof will be omitted.

The AM antenna 40*a* is an antenna for AM radio, which receives radio waves in a frequency band of AM radio. The AM antenna 40*a* has an AM feeding point 41*a* and an AM antenna wire 42*a*.

The AM feeding point 41*a* (an example of a first feeding point) is a terminal, which is constituted by a conductor such as metal so as to feed power to the AM antenna wire 42*a*. The AM feeding point 41*a* is fundamentally the same as the AM feeding point 41 in the first embodiment, but the AM feeding point 41*a* is disposed in a position farther from the defogger 30 in a parallel direction to the heating wires 31 than the AM feeding point 41 in the first embodiment. The AM feeding point 41*a* is disposed in a position displaced obliquely from an FM feeding point 51*a* in a direction leaving the defogger 30.

The AM antenna wire 42*a* (an example of a first antenna wire) is a conducting wire such as metal, which is fundamentally the same as the AM antenna wire 42 in the first embodiment. The AM antenna wire 42*a* is disposed over regions of four sides in a peripheral region of the defogger 30 (i.e., an upper region on the upper side of the heating wires 31, a left region on the left side of the bus bar 32A, a right region on the right side of the bus bar 32B, and a lower region on the lower side of the heating wires 31).

In addition, the AM antenna wire 42*a* includes an AM antenna wire 42*a*-1 (AM element) extending to the right from the AM feeding point 41*a*, and an AM antenna wire 42*a*-2 (AM element) extending downward from the AM feeding point 41*a*.

The AM antenna wire 42*a*-1 is a conducting wire disposed in the aforementioned upper region, the aforementioned right region and the aforementioned lower region, and having a loop portion 43 in the upper region and a meander portion 45 in the right region. The AM antenna wire 42*a*-1 is disposed to extend to the lower region through the loop portion 43 and the meander portion 45.

The loop portion 43 is a conducting wire pattern like a loop. An interval between conducting wires in the loop-like conducting wire pattern is a distance D3 in the same manner as the interval between conducting wires in the folded-back pattern of the AM antenna wire 42-1. The distance D3 is shorter than the distance D1. For example, the distance D3 is 10 mm. The distance D3 is determined so that the conducting wires can be capacitively coupled with each other in the frequency band of AM radio.

The meander portion 45 is a conducting wire pattern like a meander, extending outward from the closer side to the defogger 30. An interval between conducting wires in the meander-like conducting wire pattern is a distance D3 in the same manner as the interval between conducting wires in the folded-back pattern of the AM antenna wire 42-1. For example, the distance D3 is 10 mm.

The AM antenna wire 42*a*-2 is a conducting wire disposed in the aforementioned left region and the aforementioned lower region, and having a meander portion 44 in the left region.

The meander portion 44 is a conducting wire pattern like a meander, extending outward from the closer side to the defogger 30. An interval between conducting wires in the meander-like conducting wire pattern is a distance D3 in the same manner as the interval between conducting wires in the folded-back pattern of the AM antenna wire 42-1. For example, the distance D3 is 10 mm.

The FM antenna 50*a* is an antenna for FM radio, which receives radio waves in a frequency band of FM radio. The FM antenna 50*a* has an FM feeding point 51*a* and an FM antenna wire 52*a*.

The FM feeding point 51*a* (an example of a second feeding point) is a terminal, which is constituted by a conductor such as metal so as to feed power to the FM antenna wire 52*a*. The FM feeding point 51*a* is fundamentally the same as the FM feeding point 51 in the first embodiment, but the FM feeding point 51*a* is disposed in a position farther from the defogger 30 in a parallel direction to the heating wires 31 than the FM feeding point 51 in the first embodiment.

In addition, the FM antenna wire 52*a* (an example of a second antenna wire) is a conducting wire extending to the right from the FM feeding point 51*a*. The FM antenna wire 52*a* is fundamentally the same as the FM antenna wire 52 in the first embodiment. The FM antenna wire 52*a* is disposed at a distance D2 from the defogger 30. The distance D2 is determined so that the FM antenna wire 52*a* is capacitively coupled with the defogger 30 in the frequency band of FM radio. For example, the distance D2 is 5 mm.

As described above, in the back door 1*a* and the glass antenna 100*a* according to the present embodiment, the AM antenna wire 42*a* is disposed in regions of four sides in the peripheral region of the defogger 30.

As a result, in the back door 1*a* and the glass antenna 100*a* according to the present embodiment, it is possible to further improve receiving sensitivity in the frequency band of AM radio.

In addition, according to the present embodiment, the AM antenna wire 42*a* has the meander-like conducting wire parts (the meander portions 44 and 45). The interval (distance D3) between conducting wires in the meander-like conducting wire parts (the meander portions 44 and 45) is shorter than the interval (distance D1) between the defogger 30 and the AM antenna wire 42*a*.

As a result, in the back door 1*a* and the glass antenna 100*a* according to the present embodiment, it is possible to easily increase the antenna area of the AM antenna 40*a*. Further, in the back door 1*a* and the glass antenna 100*a* according to the present embodiment, due to the meander portions 44 and 45, the AM antenna 40*a* can be expanded to the lower region from the meander portions 44 and 45 in the left region and the right region. That is, in the back door 1*a* and the glass antenna 100*a* according to the present embodiment, it is possible to improve expandability and a degree of freedom in the layout of the AM antenna 40*a*.

In addition, according to the present embodiment, the interval (distance D3) between conducting wires in the meander-like conducting wire parts (meander portions 44 and 45) is determined so that the conducting wires are capacitively coupled with each other in the frequency band of AM radio.

As a result, each of the meander portions 44 and 45 has a function equivalent to a thick conducting wire (a conducting wire with a width corresponding to the distance D3). Thus, in the back door 1*a* and the glass antenna 100*a* according to the present embodiment, it is possible to further improve receiving sensitivity in the frequency band of AM radio.

In addition, according to the present embodiment, the AM antenna wire 42*a* has a loop-like conducting wire part (loop portion 43). The interval (distance D3) between conducting wires in the loop-like conducting wire part (loop portion 43) is shorter than the interval (distance D1) between the defogger 30 and the AM antenna wire 42*a*, and is determined so that the conducting wires are capacitively coupled with each other in the frequency band of AM radio.

As a result, the loop-like conducting wire part (loop portion 43) has a function equivalent to a thick conducting wire (a conducting wire with a width corresponding to the distance D3). Thus, in the back door 1*a* and the glass antenna 100*a* according to the present embodiment, it is possible to further improve receiving sensitivity in the frequency band of AM radio.

In addition, according to the present embodiment, the AM feeding point 41*a* and the FM feeding point 51*a* are disposed obliquely, and disposed further outside in comparison with those in the first embodiment.

As a result, the wiring length for connection to the two-input amplifier 11 from the AM feeding point 41*a* and the FM feeding point 51*a* can be made shorter than that in the first embodiment. Accordingly, in the back door 1*a* and the glass antenna 100*a* according to the present embodiment, the possibility that noise may be mixed into a reception signal from the wiring can be further reduced. Thus, it is possible to further improve the receiving sensitivity of the antenna.

Third Embodiment

Next, a glass antenna 100*b* according to a third embodiment will be described with reference to FIG. 5.

Figure 5:
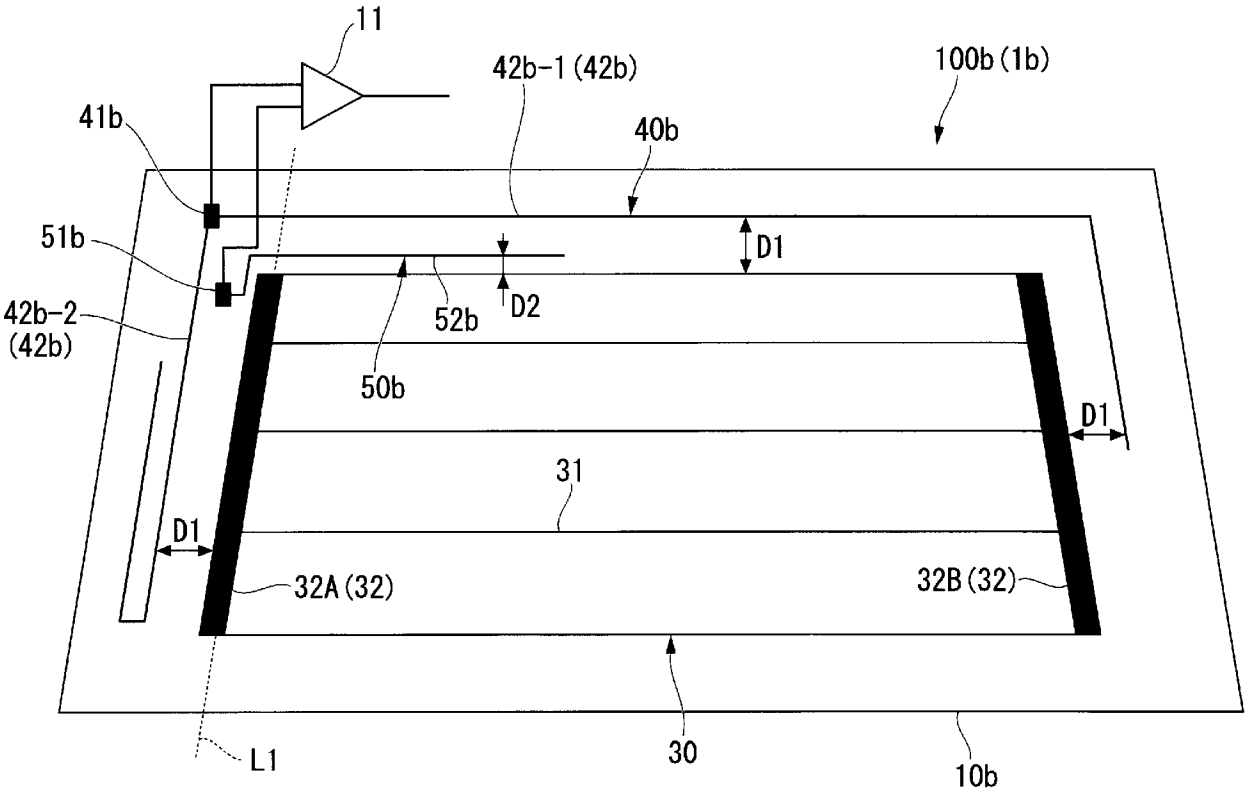
FIG. 5 is a view showing a configuration example of a glass antenna according to a third embodiment.

FIG. 5 is a view showing a configuration example of the glass antenna 100*b* according to the third embodiment.

Incidentally, a back door 1*b* according to the third embodiment is the same as the back door 1 according to the first embodiment, except that the glass antenna 100*b* is provided in place of the glass antenna 100. Therefore, description of the back door 1*b* will be omitted.

The glass antenna 100*b* shown in FIG. 5 has a rear glass 10*b* and a two-input amplifier 11. A defogger 30, an AM antenna 40*b* and an FM antenna 50*b* are disposed in the rear glass 10*b*. In FIG. 5, constituent members which are the same as those in FIG. 3 are referenced correspondingly, and description thereof will be omitted.

The AM antenna 40*b* is an antenna for AM radio, which receives radio waves in a frequency band of AM radio. The AM antenna 40*b* has an AM feeding point 41*b* and an AM antenna wire 42*b*. The AM antenna 40*b* is the same as the AM antenna 40 in the first embodiment, except that the layout of the AM feeding point 41*b* and the conducting wire pattern of the AM antenna wire 42*b* are different.

The AM feeding point 41*b* (an example of a first feeding point) is a terminal, which is constituted by a conductor such as metal so as to feed power to the AM antenna wire 42*b*. The AM feeding point 41*b* is fundamentally the same as the AM feeding point 41 in the first embodiment, but the AM feeding point 41*b* is disposed in a position farther from the defogger 30 in a parallel direction to the heating wires 31 than the AM feeding point 41 in the first embodiment.

The AM antenna wire 42*b* (an example of a first antenna wire) is a conducting wire such as metal, which is fundamentally the same as the AM antenna wire 42 in the first embodiment. The AM antenna wire 42*b* includes an AM antenna wire 42*b*-1 (AM element) extending to the right from the AM feeding point 41*b*, and an AM antenna wire 42*b*-2 (AM element) extending downward from the AM feeding point 41*b*.

The AM antenna wire 42*b*-1 is a conducting wire disposed in the aforementioned upper region and the aforementioned right region, and having no folded-back pattern.

The AM antenna wire 42*b*-2 is a conducting wire disposed in the aforementioned left region, and having a folded-back pattern in the left region.

The FM antenna 50*b* is an antenna for FM radio, which receives radio waves in a frequency band of FM radio. The FM antenna 50*b* has an FM feeding point 51*b* and an FM antenna wire 52*b*.

The FM feeding point 51*b* (an example of a second feeding point) is a terminal, which is constituted by a conductor such as metal so as to feed power to the FM antenna wire 52*b*. The FM feeding point 51*b* is fundamentally the same as the FM feeding point 51 in the first embodiment, but the FM feeding point 51*b* is disposed on the left side of the defogger 30 (in the left region).

In addition, the FM antenna wire 52*b* (an example of a second antenna wire) is a conducting wire extending to the right from the FM feeding point 51*b* through a crank-like conducting wire pattern. The FM antenna wire 52*b* is fundamentally the same as the FM antenna wire 52 in the first embodiment.

As described above, in the back door 1*b* and the glass antenna 100*b* according to the present embodiment, the AM antenna wire 42*b* is disposed in regions of three sides in the peripheral region of the defogger 30.

As a result, in the back door 1*b* and the glass antenna 100*b* according to the present embodiment, it is possible to further improve receiving sensitivity in the frequency band of AM radio.

In addition, according to the present embodiment, the FM feeding point 51*b* is disposed on the left side of the defogger 30 (in the left region).

As a result, the wiring length for connection from the AM feeding point 41*b* and the FM feeding point 51*b* to the two-input amplifier 11 can be further shortened. Accordingly, in the back door 1*b* and the glass antenna 100*b* according to the present embodiment, the possibility that noise may be mixed into a reception signal from the wiring can be further reduced. Thus, it is possible to further improve the receiving sensitivity of the antenna.

Fourth Embodiment

Next, a glass antenna 100*c* according to a fourth embodiment will be described with reference to FIG. 6.

Figure 6:
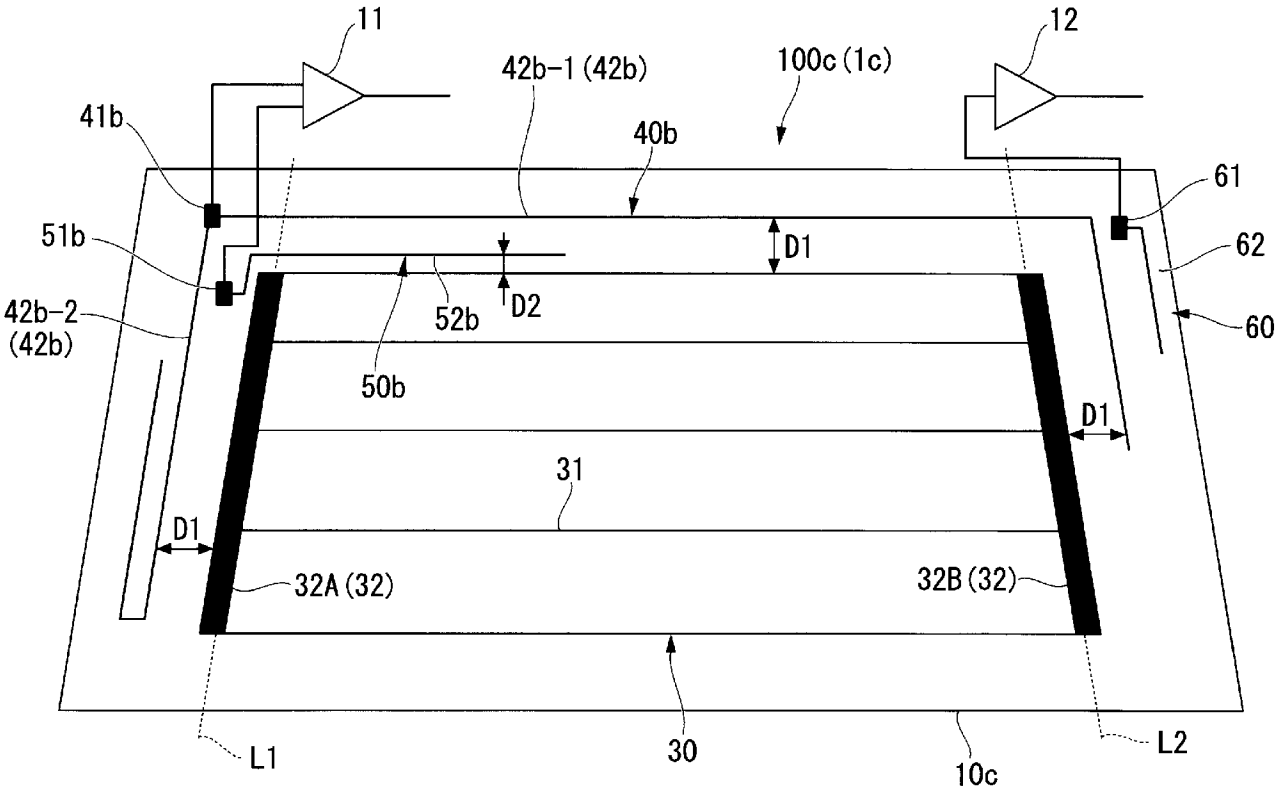
FIG. 6 is a view showing a configuration example of a glass antenna according to a fourth embodiment.

FIG. 6 is a view showing a configuration example of the glass antenna 100*c* according to the fourth embodiment.

Incidentally, a back door 1*c* according to the fourth embodiment is the same as the back door 1*b* according to the third embodiment, except that the glass antenna 100*c* is provided in place of the glass antenna 100*b*. Therefore, description of the back door 1*c* will be omitted.

The glass antenna 100*c* shown in FIG. 6 has a rear glass 10*c*, a two-input amplifier 11, and a DAB (Digital Audio Broadcast) amplifier 12. A defogger 30, an AM antenna 40*b*, an FM antenna 50*b*, and a DAB antenna 60 are disposed in the rear glass 10*c*. In FIG. 6, constituent members which are the same as those in FIG. 5 are referenced correspondingly, and description thereof will be omitted. The present embodiment is the same as the third embodiment, except that the glass antenna 100*c* includes the DAB antenna 60 and the DAB amplifier 12.

The DAB antenna 60 is an antenna for DAB, which receives radio waves in a frequency band of DAB which is higher in frequency than a frequency band of FM radio. DAB includes two different frequency bands, that is, band III ranging from 174 MHz to 240 MHz, and L-band ranging from 1,452 MHz to 1,492 MHz. The DAB antenna 60 has a DAB feeding point 61, and a DAB antenna wire 62.

The DAB feeding point 61 (an example of a third feeding point) is a terminal, which is constituted by a conductor such as metal so as to feed power to the DAB antenna wire 62. The DAB feeding point 61 is disposed in the peripheral region of the defogger 30 within the rear glass 10*c* and outside a line along each of the at least two bus bars 32 and an extension line of the line (for example, an imaginary line L2). That is, the DAB feeding point 61 is disposed outside the imaginary line L2 including a line along the bus bar 32B and an extension line of the line.

The DAB antenna wire 62 (an example of a third antenna wire) is a conducting wire extending to the right from the DAB feeding point 61. The DAB antenna wire 62 is disposed in the peripheral region of the defogger 30 (for example, in the aforementioned right region) so as to receive radio waves in the frequency band of DAB.

The DAB amplifier 12 is connected to the DAB antenna wire 62 through the DAB feeding point 61. The DAB amplifier 12 amplifies a reception signal (an example of a third reception signal) received by the DAB antenna wire 62. Although the DAB amplifier 12 shown in FIG. 6 is disposed above the rear glass 10*c* for convenience of explanation, the DAB amplifier 12 is, for example, fixed to the metal frame 21B. The DAB amplifier 12 outputs the amplified reception signal as an output signal to devices such as a car radio system and a car audio system.

As described above, in the back door 1*c* and the glass antenna 100*c* according to the present embodiment, the DAB antenna 60 and the DAB amplifier 12 are further provided.

Accordingly, in the back door 1*c* and the glass antenna 100*c* according to the present embodiment, it is possible to improve receiving sensitivity in the frequency band of AM radio, while it is also possible to receive radio waves in the frequency band of DAB. Thus, in the back door 1*c* and the glass antenna 100*c* according to the present embodiment, it is possible to achieve a low-priced antenna in which external components can be reduced.

Fifth Embodiment

Next, a glass antenna 100*d* according to a fifth embodiment will be described with reference to FIG. 7.

Figure 7:
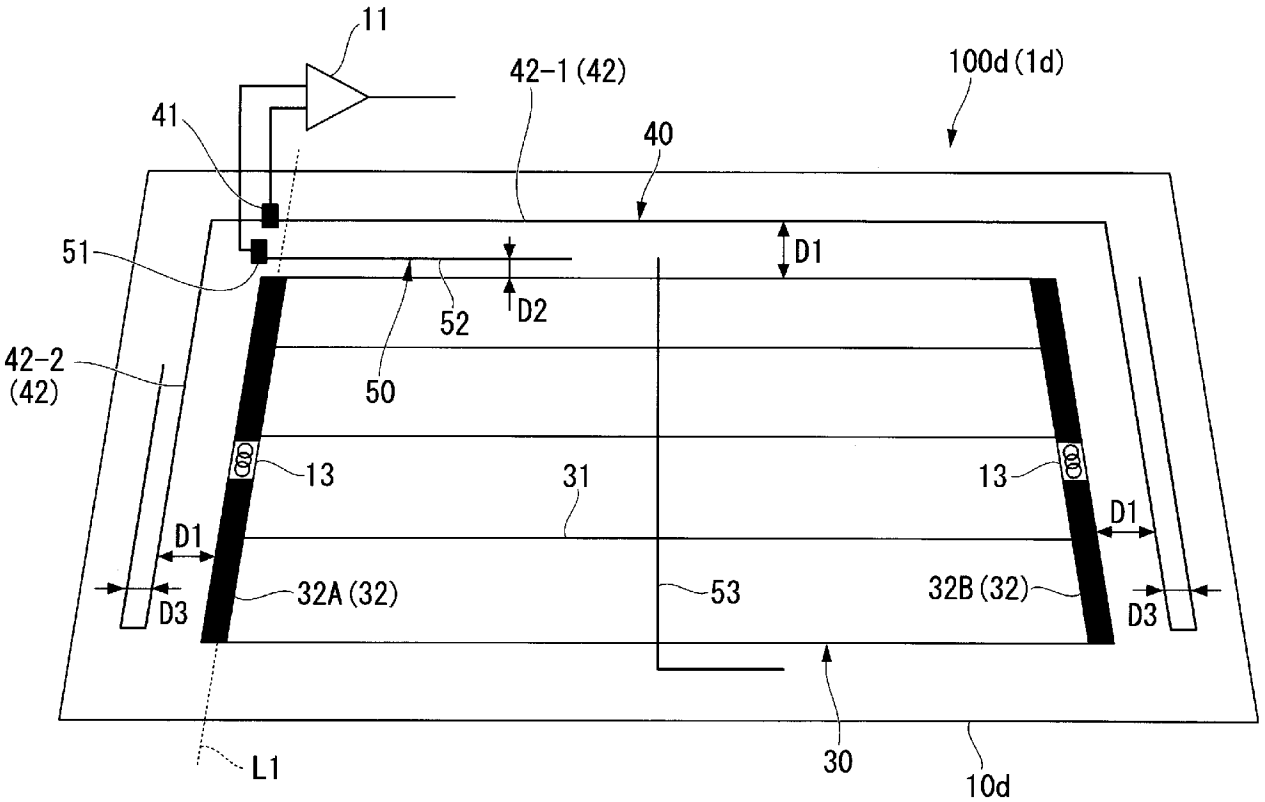
FIG. 7 is a view showing a configuration example of a glass antenna according to a fifth embodiment.

FIG. 7 is a view showing a configuration example of the glass antenna 100*d* according to the fifth embodiment.

Incidentally, a back door 1*d* according to the fifth embodiment is the same as the back door 1 in the first embodiment, except that the glass antenna 100*d* is provided in place of the glass antenna 100. Therefore, description of the back door 1*d* will be omitted.

The glass antenna 100*d* shown in FIG. 7 has a rear glass 10*d* and a two-input amplifier 11. A defogger 30, an AM antenna 40, an FM antenna 50, and an adjustment element 53, and RFC coils 13 (high-frequency choke coils) are disposed in the rear glass 10*d*. In FIG. 7, constituent members which are the same as those in FIG. 3 are referenced correspondingly, and description thereof will be omitted. The present embodiment is the same as the first embodiment, except that the glass antenna 100*d* includes the adjustment element 53 and the RFC coils 13.

Due to the RFC coils 13, the defogger 30 can be floated from the ground (reference potential of a body of a vehicle) in a frequency band of FM radio. A reception signal of radio waves in the frequency band of FM radio received by the defogger 30 can be transmitted to the FM antenna 50 by capacitive coupling.

The adjustment element 53 is an element for adjusting impedance of the defogger 30. The adjustment element 53 serves as an element for adjusting the FM antenna 50.

As described above, in the back door 1*d* and the glass antenna 100*d* according to the present embodiment, the RFC coils 13 and the adjustment element 53 are further provided.

As a result, in the back door 1*d* and the glass antenna 100*d* according to the present embodiment, it is possible to improve receiving sensitivity in the frequency band of AM radio, while it is also possible to improve receiving sensitivity in the frequency band of FM radio.

Incidentally, the present invention is not limited to any one of the aforementioned embodiments. The present invention can be modified without departing from the gist of the present invention.

For example, a part or all of the embodiments may be combined and carried out. In addition, the shapes and arrangements of the AM antenna 40 (40*a*, 40*b*) and the FM antenna 50 (50*a*, 50*b*) are not limited to those in any one of the embodiments, but the shapes and arrangements thereof may be changed without departing from the gist of the present invention.

In addition, although each embodiment has been described along an example in which the back door 1 (1*a* to 1*d*) is a door that can be opened and closed vertically, it may be a door that can be opened and closed horizontally.

In addition, in each embodiment, the shape of the metal frame 21 is not limited to that in the embodiment, but it may be replaced by another shape. When the metal frame 21 is put at a distance from the AM antenna 40 (40*a*, 40*b*), receiving sensitivity of the AM antenna 40 (40*a*, 40*b*) can be improved. It is therefore preferable that the metal frame 21 has a shape that can be disposed at a distance from the AM antenna 40 (40*a*, 40*b*).

The present application is based on Japanese Patent Application No. 2016-057453 filed on Mar. 22, 2016, the contents of which are incorporated herein by reference.

DESCRIPTION OF REFERENCE NUMERALS AND SIGNS

1, 1*a*, 1*b*, 1*c*, 1*d* back door
2 vehicle body
10, 10*a*, 10*b*, 10*c*, 10*d* rear glass
11 two-input amplifier
12 DAB amplifier
13 RFC coils
20 resin panel
21, 21A, 21B metal frame
30 defogger
31 heating wires
32, 32A, 32B bus bar
40, 40*a*, 40*b* AM antenna
41, 41*a*, 41*b* AM feeding point
42, 42-1, 42-2, 42*a*, 42*a*-1, 42*a*-2, 42*b*, 42*b*-1, 42*b*-2 AM antenna wire
43 loop portion
44, 45 meander portion
50, 50*a*, 50*b* FM antenna
51, 51*a*, 51*b* FM feeding point
52, 52*a*, 52*b* FM antenna wire
53 adjustment element
60 DAB antenna
61 DAB feeding point
62 DAB antenna wire
100, 100*a*, 100*b*, 100*c*, 100*d* glass antenna

What is claimed is:

1. A back door made from resin to be openably and closably attached to a rear portion of a vehicle, the back door comprising a glass antenna, wherein the glass antenna comprises:

a defogger comprising a plurality of heating wires and at least two bus bars which connect end portions of the heating wires such that electric power is supplied to the heating wires;

a first antenna wire disposed along at least three sides of a perimeter of the defogger and configured to receive radio waves in a first frequency band;

a second antenna wire which is disposed in a peripheral region of the defogger and configured to receive radio waves in a second frequency band which is higher in frequency than the first frequency band; and an amplification portion configured to synthesize and amplify a first reception signal received by the first antenna wire and a second reception signal received by the second antenna wire, and wherein the glass antenna has no choke coil that blocks a signal of the first frequency band between a body of the vehicle and the defogger, the first antenna wire is an amplitude modulation (AM) antenna wire and is disposed at least a first distance from the defogger, the first distance being a shortest distance between the AM antenna wire and the defogger, the second antenna wire is a frequency modulation (FM) antenna wire and is disposed at a second distance from the defogger such that the FM antenna wire is capacitively coupled with the defogger in a frequency band of FM radio, the second distance being shorter than the first distance, and the first distance is 40 mm.

2. The back door according to claim 1, wherein:

the amplification portion is connected to the first antenna wire through a first feeding point and connected to the second antenna wire through a second feeding point; and at least one of the first feeding point or the second feeding point is disposed in the peripheral region and outside a line along each of the at least two bus bars and an extension line of the line.

3. The back door according to claim 1, wherein:

the first antenna wire comprises a meander-like conducting wire part; and an interval between conducting wires in the meander-like conducting wire part is shorter than an interval between the defogger and the first antenna wire.

4. The back door according to claim 3, wherein:

the interval between the conducting wires in the meander-like conducting wire part is determined such that the conducting wires are capacitively coupled with each other in the first frequency band.

5. A glass antenna for use in a back door made from resin to be openably and closably attached to a rear portion of a vehicle, the glass antenna comprising:

a defogger comprising a plurality of heating wires and at least two bus bars which connect end portions of the heating wires such that electric power is supplied to the heating wires;

a first antenna wire disposed along at least three sides of a perimeter the defogger, so as to receive radio waves in a first frequency band;

a second antenna wire which is disposed in a peripheral region of the defogger and configured to receive radio waves in a second frequency band which is higher in frequency than the first frequency band; and an amplification portion configured to synthesize and amplify a first reception signal received by the first antenna wire and a second reception signal received by the second antenna wire, wherein the glass antenna has no choke coil that blocks a signal of the first frequency band between a body of the vehicle and the defogger, the first antenna wire is an amplitude modulation (AM) antenna wire and is disposed at least a first distance from the defogger, the first distance being a shortest distance between the AM antenna wire and the defogger, the second antenna wire is a frequency modulation (FM) antenna wire and is disposed at a second distance from the defogger such that the FM antenna wire is capacitively coupled with the defogger in a frequency band of FM radio, the second distance being shorter than the first distance, and the first distance is 40 mm.

6. The back door according to claim 2, wherein:

the first feeding point is disposed in the peripheral region and outside a line along each of the at least two bus bars and an extension line of the line.

7. The back door according to claim 6, wherein:

the second feeding point is disposed in the peripheral region and outside a line along each of the at least two bus bars and an extension line of the line.

8. The back door according to claim 7, wherein:

the second feeding point is disposed in a position closer to the defogger than the first feeding point.

9. The glass antenna according to claim 5, wherein:

the amplification portion is connected to the first antenna wire through a first feeding point and connected to the second antenna wire through a second feeding point; and at least one of the first feeding point and the second feeding point is disposed in the peripheral region and outside a line along each of the at least two bus bars and an extension line of the line.

10. The glass antenna according to claim 9, wherein:

the first feeding point is disposed in the peripheral region and outside a line along each of the at least two bus bars and an extension line of the line.

11. The glass antenna according to claim 10, wherein:

the second feeding point is disposed in the peripheral region and outside a line along each of the at least two bus bars and an extension line of the line.

12. The glass antenna according to claim 11, wherein:

the second feeding point is disposed in a position closer to the defogger than the first feeding point.

13. The glass antenna according to claim 5, wherein:

the first antenna wire comprises a meander-like conducting wire part; and an interval between conducting wires in the meander-like conducting wire part is shorter than an interval between the defogger and the first antenna wire.

14. The glass antenna according to claim 13, wherein:

the interval between the conducting wires in the meander-like conducting wire part is determined such that the conducting wires are capacitively coupled with each other in the first frequency band.

* * * * *